US007691158B2

(12) United States Patent
Jordan et al.

(10) Patent No.: US 7,691,158 B2
(45) **Date of Patent: *Apr. 6, 2010**

(54) HYDROCARBON FUEL ADDITIVES AND FUEL FORMULATIONS EXHIBITING IMPROVED COMBUSTION PROPERTIES

(75) Inventors: Frederick L. Jordan, Santa Ana, CA (US); Geoffrey E. Dolbear, Diamond Bar, CA (US)

(73) Assignee: Oryxe Energy International, Inc., Irvine, CA (US)

( * ) Notice: Subject to any disclaimer, the term of this patent is extended or adjusted under 35 U.S.C. 154(b) by 1396 days.

This patent is subject to a terminal disclaimer.

(21) Appl. No.: 10/877,704

(22) Filed: Jun. 25, 2004

(65) Prior Publication Data

US 2005/0284019 A1 Dec. 29, 2005

(51) Int. Cl.
*C10L 1/18* (2006.01)
*C10L 1/22* (2006.01)

(52) U.S. Cl. ..... 44/329; 44/300; 44/439

(58) Field of Classification Search ..... 44/300, 44/439, 329

See application file for complete search history.

(56) References Cited

U.S. PATENT DOCUMENTS

| | | | | |
|---|---|---|---|---|
| 3,111,533 | A | 11/1963 | Ecke | |
| 3,206,290 | A | 9/1965 | McDermott | |
| 4,048,118 | A | 9/1977 | Suzaka et al. | |
| 4,240,801 | A * | 12/1980 | Desmond, Jr. | 44/326 |
| 5,612,485 | A * | 3/1997 | Schlipalius | 585/351 |
| 5,826,369 | A | 10/1998 | Jordan | |
| 5,906,662 | A * | 5/1999 | McCombes | 44/300 |
| 7,064,101 | B2 * | 6/2006 | Tanaka et al. | 510/446 |
| 2002/0194778 | A1 | 12/2002 | Jordan | |
| 2003/0089026 | A1 | 5/2003 | Jordan | |
| 2003/0089027 | A1 | 5/2003 | Jordan | |
| 2003/0089029 | A1 | 5/2003 | Jordan | |
| 2003/0093942 | A1 | 5/2003 | Jordan | |
| 2003/0093943 | A1 | 5/2003 | Jordan | |
| 2003/0093945 | A1 | 5/2003 | Jordan | |
| 2003/0097782 | A1 | 5/2003 | Jordan | |

FOREIGN PATENT DOCUMENTS

| | | | |
|---|---|---|---|
| MX | PA04012633 | A | 8/2005 |
| WO | 00/32724 | A1 | 6/2000 |
| WO | WO0277105 | * | 3/2002 |

OTHER PUBLICATIONS

Astaxanthin Biochemical Properties, 2002. www.astaxanthin.org/astax.htm.*

Bickoff, Comparative Evaluation of Antioxidants for Carotene, 1952,The Journal of the American Oil Chemists' Society,445-446.*

Astaxanthin Biochemical Properties, date unknown; http://www.astaxanthin.org/astax.htm.*

(Continued)

*Primary Examiner*—Cephia D Toomer
(74) *Attorney, Agent, or Firm*—Fulbright & Jaworski, L.L.P.

(57) ABSTRACT

Fuel additives, fuel formulations, and processes for their preparation and use are provided. The additives improve the combustion properties of hydrocarbon fuels. The enhanced combustion indicates reductions in certain emissions.

17 Claims, 2 Drawing Sheets

OTHER PUBLICATIONS

Alekseev, E.V., et al., "Inhibition of □-Carotene Oxidation in an Aromatic Solvent;" Bulletin of the Academy of Sciences of the USSR, Division of Chemical Science, 312-316 (1970).

Coronene. From the U.S. National Library Of Medicine. Online; printed Apr. 15, 2009.

Phytic Acid; Myo-Inositol, hexakis (dihydrogen phosphate), hexazinc salt. From the U.S. National Library Of Medicine: Online; printed Apr. 15, 2009.

Policyclic Aromatic Hydrocarbons. Chart with drawings. Printed May 20, 2009.

Translation of Official Letter from Mexican Institute of Industrial Property (MPIP) dated May 20, 2009, during the prosecution of Mexican Patent Application No. PA/A/2005/014069.

Official Letter from Mexican Institute of Industrial Property (MPIP) dated Nov. 10, 2009, during the prosecution of Mexican Patent Application No. PA/A/2005/014069.

* cited by examiner

HYDROCARBON FUEL ADDITIVES AND FUEL FORMULATIONS EXHIBITING IMPROVED COMBUSTION PROPERTIES

TECHNICAL FIELD

The invention relates to new and useful additives for hydrocarbon-based fuels, fuel formulations, method of production and use. More specifically, the invention is directed to compounds, materials and processes for improving the combustion characteristics of fuels so as to reduce undesirable polluting emissions produced during burning.

BACKGROUND OF THE INVENTION

The present invention relates generally to composition and method for improving combustion and reducing polluting emissions in fuels.

The interest in improving fuel efficiency has become paramount as our natural resources dwindle and the cost of fuel continues to rise. Fuel efficiency and improved emissions characteristics can be improved by adding a fuel additive to hydrocarbon fuels. Several existing fuel additives are known to increase fuel efficiency, for example, U.S. Pat. Nos. 4,274,835, 5,826,369, and 6,193,766 describe fuel additives that improve combustion. Despite the successes of these inventions, there still remains a need for fuel additives that improve combustion.

When hydrocarbon based fuels are combusted, various pollutants are generated. These combustion products include particulates, carbon monoxide, nitrogen dioxide, sulfur dioxide, and lead (where leaded fuels are still in use). Ozone is also a pollutant (although not directly produced) that results from unburned hydrocarbons. Both the U.S. Environmental Protection Agency (EPA) and the California Air Resources Board (CARB) have adopted ambient air quality standards directed to these pollutants. Both agencies have also adopted specifications for lower-emission gasolines and diesel fuels.

In response to these legislative efforts, producers of hydrocarbon fuels, for example gasoline, diesel, jet and the like, have attempted to readjust refinery processes so as to produce base fuels meeting these more rigid specifications. Such an approach suffers from a number of drawbacks, including the high costs involved in reconfiguring a refinery process, reduced production of the refinery, and the like. Accordingly, fuels that do not suffer these and other related economic drawbacks are highly desirable.

Hydrocarbon fuels typically contain complex mixtures of hydrocarbons, depending on the specific application: including but not limited to gasoline, diesel, jet, fuel oils, coal fuels, resid fuels, kerosene, and the like. Fuels typically may also contain other additives, including detergents, anti-icing agents, emulsifiers, corrosion inhibitors, dyes, deposit modifiers, ignition modifiers and non-hydrocarbons, for example oxygenates, for improving the emission characteristics of fuels.

It would be desirable to find compounds that have a positive effect on reducing the emissions characteristics of burnt hydrocarbon fuels. The improvement in burning (combustion such as in a jet, diesel, or gasoline engine) and emissions characteristics can be correlated to certain fuel burning testing procedures. The Smoke Point of certain fuels, including additives, can be tested using ASTM test D 1322-90 *Standard Test Method for Smoke Point of Aviation Turbine Fuels*. This testing procedure is hereby incorporated by reference. In particular, the test of Smoke Point can be used to show the effect of additives on a standard jet engine fuel such as A, 1, JP-4 or JP-8 (herein after all known as "Jet") that exhibit a reproducible height of a smokeless flame when burned in wick-fed lamp of the ASTM test. This test is qualitatively related to the potential radiant heat transfer from the combustion products of the fuel. Additives incorporated into a fuel that improve the combustion characteristics, that is completeness of burning, exhibit a higher smoke point. This effect can be synergistic and unexpected for certain additives that have not been previously known as additives to Hydrocarbon fuels for this purpose. When improvements in Smoke Point are found this positively correlates to reducing polluting emissions into the environment. As reduced emissions are desirable, there is an ongoing need for HC fuels that incorporate new and useful additives to accomplish the same. Accordingly, the present invention provides solutions to this ongoing problem of polluting emissions from various internal combustion devices, for example, automotive engines, diesel engines (so-called piston engines), coal burning plants, aero-engines, jet engines, two-stroke engines, and the like, thereby overcoming many of the aforementioned limitations in the hydrocarbon fuel formulation art.

BRIEF SUMMARY OF THE INVENTION

The invention relates to additives for hydrocarbon fuels that improve combustion and reduce emissions when added in small quantities. Hydrocarbon fuels can be thought of as including, but not limited to gasoline, diesel, oil fuels, coals and the like that provide for the production of radiant heat when combined in the presence of oxygen and a source of ignition. These fuels are useful in automobiles, motorcycles, trucks, generators, power plants and the like.

The invention includes a fuel additive for hydrocarbon fuels comprising a molecule having a system of between 2 and about 11 (or more) conjugated carbon-carbon double bonds. For the purposes of the present invention, the term conjugated includes aromatic species, for example, in a preferred embodiment, biphenyl. The conjugated group can further comprise at least one end group comprising a cyclic linear or branched 5 to 8 carbon saturated, unsaturated or aromatic moiety. If the additive comprises at least two aromatic moieties then a single double carbon bond between them is optional. The additive an be further substituted with oxygen-containing groups, for example hydroxyl or keto groups. Other substituents include least one $C_1$ to $C_6$ containing group, branched or linear that can be substituted on the system of conjugated carbon-carbon double bond containing groups, the end group moiety, or combinations of both. The fuel additive can be a molecule comprised of at least 12 carbon atoms and as high as about 40 to 50 carbon atoms.

The fuel additives according to the above description can include mixtures of cis and trans beta-carotenes, These compounds can be derived from natural and/or synthetic sources. In the case of mixtures of cis and trans beta-carotenes, these can be in the form of precursors from a process to manufacture pure trans beta-carotene. The fuel additive can be astaxanthin or an astaxanthin derivatives obtained from synthetic or natural sources. Additionally, the additive can include mixtures of cis and trans beta-carotenes and astaxanthin and/or an astaxanthin derivatives obtained from synthetic or natural sources. Preferred aromatic group containing compounds can be selected for example from the group of cis-stilbene, trans-stilbene, 1,6 diphenyl-1,3,5-hexatriene, 1,4-diphenyl-1,3-butadiene, 1,4-diphenyl-2-methyl-1,3 butadiene, 1,4-diphenyl butadiene, bibenzyl and mixtures of with or without carotenes, astaxanthin, or lutein derived compounds.

In another embodiment the fuel additive can further comprise a solubilizing agent such as a surfactant having a hydrophobic-lipophillic balance to enhance the solubility of a fuel additive in a hydrocarbon fuel. Particularly useful solubilizing agents are those that comprise an ethoxylated or propoxylated moiety having from about 6 to about 25 or 30 ethox- or propoxylated moieties derived from ethylene oxide and/or propylene oxide units. For example, and ethoxylated macadamia nut oil having about 12 to 16 ethoxylations.

It has been found that when additives having conjugated groups are used that oxygen can decrease the effectiveness of the additives. Accordingly, it can be critical in some additives to exclude oxygen from the beginning of their manufacturing process through the preparation of fuel additives and their addition to a fuel. Additionally, in another embodiment of the invention there can be included an antioxidant such as a quinoline compound or derivative or equivalent material. In another embodiment, there is provided a method of making a fuel composition comprising at least one additive of the present invention includes the steps of: obtaining a fuel additive prepared or synthesized in a low oxygen or oxygen free environment; removing a substantial portion of dissolved oxygen from a fuel solvent or diluent; preparing an additized solution by mixing the solvent or diluent with the fuel additive under reduced oxygen conditions prior to additizing a fuel and additizing the fuel.

In another embodiment of the invention there is provided a phytic acid (inositol hexaphosphoric acid) based fuel additive. The phytic acid can be a water solution, a salt or mixture. A surfactant for example, a macadamia nut oil-based surfactant and effective amount of an antioxidant such as a quinoline compound to provide enhanced oxidation resistance can be added.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the disclosure. The novel features which are believed to be characteristic of the invention, both as to its organization and method of operation, together with further objects and advantages will be better understood from the following description when considered in connection with the accompanying Figures. It is to be expressly understood, however, that each of the Figures is provided for the purpose of illustration and description only and is not intended as a definition of the limits of the present invention.

DETAILED DESCRIPTION OF THE INVENTION

Figure 1:
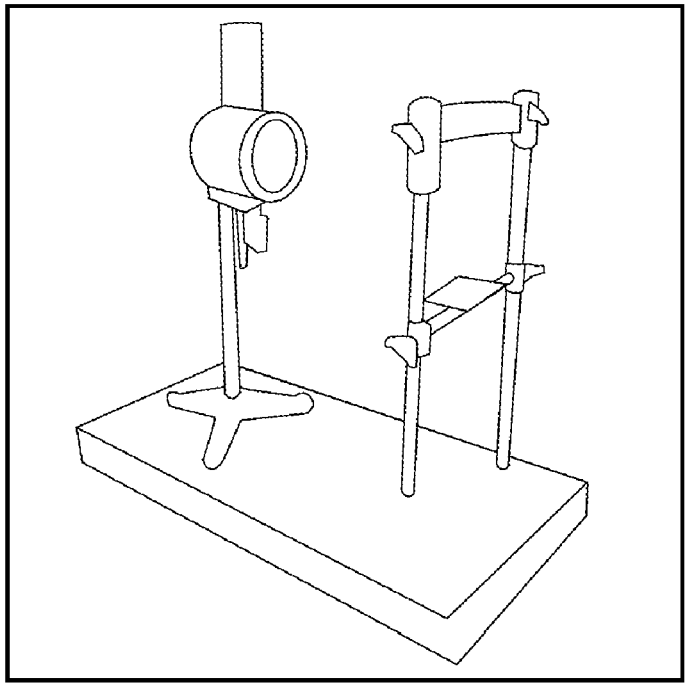
FIG. 1 illustrates the Smoke Point Apparatus utilized in the present disclosure for obtaining Smoke Point.

The following description and examples illustrate certain embodiments of the present invention and include a preferred embodiment for each of the various types of fuel additives, formulations and processes. It will be recognized by those of skill in the art that variations and modifications of the disclosed invention are possible, and accordingly, the description of the embodiments should not be view to limit the scope of the invention.

While not wishing to be bound by any particular theory regarding the mode of action of the presently disclosed fuel additives, it is believed that additives which enhance the combustion characteristics of hydrocarbon based fuels, and thus improve emissions characteristics of burnt fuels, are enhanced by including certain groups of molecular structures that have structural parameters hereto not realized as especially useful. In particular it is believed that molecules that include extended pi-bonded systems, multiple hydrocarbon rings, provide improved combustion characteristics. Such molecules when added in the parts per million to parts per thousand range having the aforementioned characteristics often show improved combustion characteristics when formulated into a hydrocarbon fuel. Further, it is believed that using solubilizing agents such as surfactants that can include oxygen atoms in their structures (e.g. PEG-type surfactants) in combination with the aforementioned further improves combustion efficiency.

With a view to the foregoing, molecules having extended pi or double bonded structures of from about 2 to 11 or more conjugated double bonds are believed to enhance combustion characteristics and thus lower pollution when properly incorporated into a fuel such as Jet or diesel and the like. The moieties including the double bond structures can be terminated by at least one end group further comprising an aromatic, cyclic branched 5 to 8 carbon moiety that can be additionally saturated or unsaturated. Examples include: cyclo-pentane, cyclo-pentene, cyclo-hexane, cyclo-hexene, cyclo-heptane, cyclo-heptene, isopentane or isopentene and the like. Aromatic structures are considered as extended pi structures also. The unsaturated/aromatic portions and the end groups can additionally include various other substituents such as hydroxyl groups, keto groups, alkyl groups, alkenyl groups and combinations of these groups. Additionally, the additive molecules can comprise from 12 to about 40 or 50 carbon atoms. Such molecules are found in mixtures of synthetic carotenoid precursors. One such mixture is a product called "Iso-mixtene" which is an intermediate used in the manufacture of synthetic trans beta carotene. Iso-Mixtene is a product of DSM chemicals (Texas), (formerly, Roche Vitamins, Inc): and is an admixture of from about 89 to about 98% trans β carotene with the remainder being from about 1.4 to 11% of cis β carotene isomers. These can be obtained from a natural or a synthetic source. The carotinoids and/or carotenoid precursors can also be those disclosed in German patent 954,247, issued in 1956.

In another embodiment of the invention, compounds within the above description are astaxanthin or astaxanthin derivatives obtained from synthetic or natural sources, or lutein or lutein derivatives obtained from synthetic or natural sources. Other embodiments include molecules having two aromatic end groups such as cis and trans stilbene, bibenzyl or a derivative having hydroxyl groups, or alkyl or alkenyl groups substituted on the phenyl rings; or 1,6 diphenyl-1,3,5-hexatriene substituted or not substituted as described previously. The in preferred embodiments the additives can be added to a fuel in concentrations from at least one part per million upwards to provide a level of improved combustion and reduced pollution.

One embodiment of the invention includes adding a solubilizing agent such as a surfactant having a hydrophobic-lipophillic balance to enhance the solubility of a fuel additive in an HC. When higher molecular weight additives contemplated by the present invention are incorporated to improve combustion properties there can be solubility limits that can be overcome on the addition of a solubilizing agent such as a surfactant or surfactant systems. These solubilizing agents can additionally comprise oxygen-containing species, for example an ethoxylated or propoxylated moiety such as polyethylene- or polypropylene glycol modified oils that can further synergistically enhance the combustion of fuels when incorporated with the additives. These materials can be used in amounts that are sufficient to provide the desired degree of solubilization as can be determined by one of skill in the art. Typically they can be added in amounts up to a 10 or 100 fold excess of the inventive additive molecules.

Another aspect of the present invention involves relates to methods of preparing the additives and the fuels in the absence of oxygen and optionally in the presence of an antioxidant. Certain compounds are capable of performing as both antioxidants and as thermal stabilizers. Therefore, it is possible to prepare formulations containing a single compound that provides both a thermal stability and antioxidant effect. Examples of compounds known in the art as providing some degree of oxidation resistance and or thermal stability include diphenylamines, dinaphthylamines, and phenylnaphthylamines, either substituted or unsubstituted, e.g., N,N'-diphenylphenylenediamine, p-octyldiphenylamine, p,p-dioctyldiphenylamine, N-phenyl-1-naphthylamine, N-phenyl-2-naphthylamine, N-(p-dodecyl)phenyl-2-naphthylamine, di-1-naphthylamine, and di-2naphthylamine; phenothazines such as N-alkylphenothiazines; imino(bisbenzyl); and hindered phenols such as 6-(t-butyl)phenol, 2,6-di-(t-butyl)phenol, 4-methyl-2,6-di-(t-butyl) phenol, 4,4'-methylenebis(-2,6-di-(t-butyl)phenol), and the like. In preferred embodiments, compounds such as quinolines and in particular such as 6-ethoxy-1,2-dihydro-2,2,4-trimethylquinoline ("EDTMQ") or other equivalent agent. Various compounds known for use as oxidation inhibitors can be utilized in fuel formulations of various embodiments. These include phenolic antioxidants, amine antioxidants, sulfurized phenolic compounds, and organic phosphites, among others. For best results, the antioxidant includes predominately or entirely either (1) a hindered phenol antioxidant such as 2,6-di-tert-butylphenol, 4-methyl -2,6-di-tert-butylphenol, 2,4-dimethyl-6-tert-butylphenol, 4,4'-Methylenebis(2,6-di-tert-butylphenol), and mixed methylene bridged polyalkyl phenols, or (2) an aromatic amine antioxidant such as the cycloalkyl-di-lower alkyl amines, and phenylenediamines, or a combination of one or more such phenolic antioxidants with one or more, such amine antioxidants. Particularly preferred are combinations of tertiary butyl phenols, such as 2,6-di-tert-butylphenol, 2,4,6-tri-tert-butylphenol and o-tert-butylphenol. Also useful are N,N'-di-lower-alkyl phenylenediamines, such as N,N'-di-sec-butyl-p-phenylenediamine, and its analogs, as well as combinations of such phenylenediamines and such tertiary butyl, phenols.

Additionally, fuel preparation methods that can remove substantial portions of oxygen from additives or solvents or diluents that are to contain additives include pumping under partial vacuum or sonication in an inert atmosphere and the like prior to additizing a fuel are preferred. Combinations of materials and process steps are especially preferred.

These materials can be added in amounts of typically 1 to 100 mls per gallon of a diluent or solvent such as toluene, cyclohexene, xylene(s) and the like. In one preferred embodiment, the additives concentrations are added in ppm quantities: from about 1 to about 1000 ppm. For example, the ppm quantities can be incremental in steps of 1, 3, 5, 7 9 ppm etc. In a solvent or diluent the diluted ranges can be from 500 to 10,000 ppm of the base additive In another preferred embodiment the additives are added in quantities of approximately 500 ppm increments, for example about 1000, 1500, 2000, 2500 to about 10,000, ppm. In still another preferred embodiment, the additives are additized in amounts of about 1000 to 1100 ppm, 2000 to 2200 ppm, 3000 to about 3500 ppm and 4000 to about 4500 ppm. In still another preferred embodiment the additives are additized in amounts of about 1057 ppm, 2114 ppm, and 4227 ppm.

In the case of a diesel fuel composition, it can also contain a cetane improver or ignition accelerator. The ignition accelerator is preferably an organic nitrate different from and in addition to the nitrate or nitrate source described above. Preferred organic nitrates are substituted or unsubstituted alkyl or cycloalkyl nitrates having up to about 10 carbon atoms, preferably from 2 to 10 carbon atoms. The alkyl group can be either linear or branched. Specific examples of nitrate compounds suitable for use in preferred embodiments include, but are not limited to the following: methyl nitrate, ethyl nitrate, n-propyl nitrate, isopropyl nitrate, allyl nitrate, n-butyl nitrate, isobutyl nitrate, sec-butyl nitrate, tert-butyl nitrate, n-amyl nitrate, isoamyl nitrate, 2-amyl nitrate, 3-amyl nitrate, tert-amyl nitrate, n-hexyl nitrate, 2-ethylhexyl nitrate, n-heptyl nitrate, sec-heptyl nitrate, n-octyl nitrate, sec-octyl nitrate, n-nonyl nitrate, n-decyl nitrate, n-dodecyl nitrate, cyclopentylnitrate, cyclohexylnitrate, methylcyclohexyl nitrate, isopropylcyclohexyl nitrate, and the esters of alkoxy substituted aliphatic alcohols, such as 1-methoxypropyl-2-nitrate, 1-ethoxpropyl-2 nitrate, 1-isopropoxy-butyl nitrate, 1-ethoxylbutyl nitrate and the like. Preferred alkyl nitrates are ethyl nitrate, propyl nitrate, amyl nitrates, and hexyl nitrates. Other preferred alkyl nitrates are mixtures of primary amyl nitrates or primary hexyl nitrates. By primary is meant that the nitrate functional group is attached to a carbon atom which is attached to two hydrogen atoms. Examples of primary hexyl nitrates include n-hexyl nitrate, 2-ethylhexyl nitrate, 4-methyl-n-pentyl nitrate, and the like. Preparation of the nitrate esters can be accomplished by any of the commonly used methods: such as, for example, esterification of the appropriate alcohol, or reaction of a suitable alkyl halide with silver nitrate. These additives can be present in the same or different amounts as the inventive additives and in preferred embodiments, especially preferred cetane improvers are added in amounts equal to or multiples of the quantities in ppm of the inventive additives.

Embodiments based on phytic acid are also contemplated. In one embodiment, there is provided a fuel additive comprising phytic acid, (inositol hexaphosphoric acid), and an ethoxylated nut oil such as ethoxylated macadamia nut oil. In an especially preferred embodiment an effective amount of EDTMQ can be used to provide enhanced oxidation resistance. The phytic acid can be the disodium salt, available from Aldrich Chemical, mixed at a concentration of from about 1 to about 5, preferably about 1.5 to about 3 grams into 450 mls. of toluene. Into this solution from about 40 to about 60, preferably about 50 mls. of ethoxylated Macadamia nut oil—the ethoxylated portion having, on average 16 ethylene glycol repeat units. An antioxidant such as EDTMQ can be added in an amount of from about 0.5 to about 3 or more, preferably about 1.0 ml. into this solution. In especially preferred embodiments, the additive was additized into 50 mls. of Jet A fuel and burned in the ASTM smoke point apparatus. Formulation exhibited an ASTM smoke point of between 22.0 and 22.5.

In another embodiment of the invention, a method of preparing fuel additives and fuels comprises steps including, adding an additive directly to a fuel; mixing, dissolving or combining an additive into a diluent or solvent, the resulting solution being finally diluted into a fuel and variations thereof are disclosed. An especially preferred method of making a fuel composition comprises the steps of obtaining a fuel additive prepared in a low oxygen or oxygen free environment; removing a substantial portion of dissolved oxygen from a fuel solvent or diluent; preparing an additized solution by mixing the solvent or diluent with the fuel additive under reduced oxygen conditions prior to additizing a fuel and additizing a fuel.

In another embodiment, a method of using the fuels, and additives of the present invention include but are not limited to adding an additive directly to a fuel and burning the fuel in an internal combustion engine, gas turbine or other such device is disclosed. Additionally, methods of using the additives include preparing intermediate solutions of the additives, mixing the same into a fuel at an effective ratio and burning the additive-enhanced fuel in a suitable device are disclosed.

Formulated fuels compositions of preferred embodiments can contain additives other than the ones described. These additives can include, but are not limited to, one or more octane improvers, detergents, antioxidants, demulsifies, corrosion inhibitors and/or metal deactivators, diluents, cold flow improvers, thermal stabilizers, and the like, as described below.

EXAMPLES

In order to test the radiant heat transfer potential of a fuel additive, the Smoke Point Lamp described in ASTM D 1322-90 is used: the teachings of this testing method are hereby incorporated by reference. The apparatus consists of a base, a candle mounted on the base, a candle socket mounted on the base, a housing which defines a so-called "gallery" in which the wick is guided into from below is mounted above the candle on the base, a scale portion for viewing a flame is attached parallel to the wick burner inside the housing, a chimney for expelling combusted products forms the upper portion of the gallery and a transparent quartz window that is a cover for the housing is attached in a manner so that it can be opened to access the ASTM wick and through which to view a flame. This device is described in FIG. 1 in the test procedure bulletin.

In order to improve the accuracy of the basic Smoke Point Burning test, the lamp is mounted onto a massive, rigid test base in conjunction with an adjustable stand to position the head of a tester in such a manner so as to reduce reading errors in the scale in the Smoke Point apparatus. This stand is mounted vertically parallel to the lamp and in such a fashion that the eyes of the tester viewing a flame test are in a constant position relative to the distance from the flame and constant relative to the height of the smoke point lamp housing. In summary, this improvement in the testing apparatus and method allows a tester to position his or her head in a consistent position relative to the flame in the housing. Thus, more consistent and accurate data are obtained for the smoke point.

Figure 2:
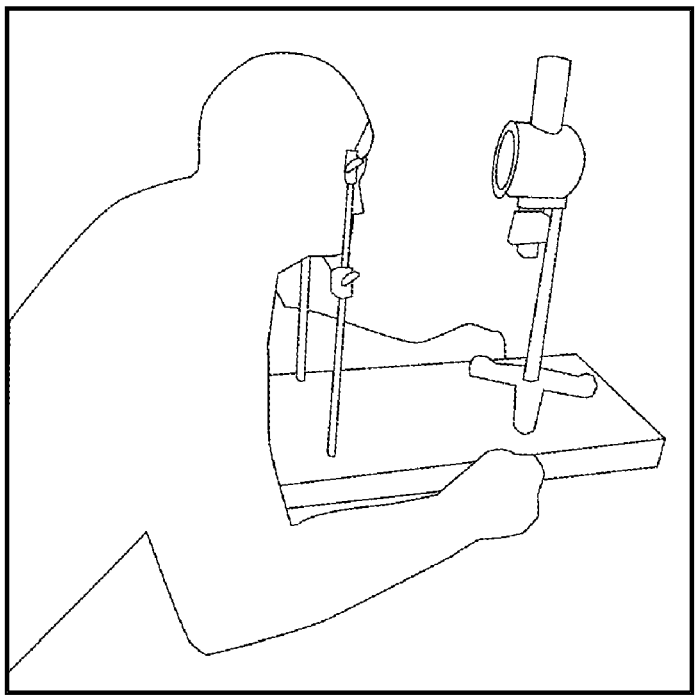
FIG. 2. illustrates an Experimentalist using the Head Rest and Smoke Point Apparatus.

The test consists of preparing a fuel sample, adding the fuel to lamp, burning the fuel via the wick fed lamp that is calibrated against a known smoke point composition, in the present case, so-called standard Jet A or 1, and observing on the scale the correct height of the flame that can be achieved with the test fuel without smoking. The flame height is estimated to the nearest millimeter. All values in the Examples below are estimated to the nearest 0.5 mm and this significant figure is made possible by using the Experimentalist's headrest as shown in FIGS. 1 and 2.

When used as a described, this test is also a measure of combustion efficiency and pollution reduction when using the standard method for testing Jet fuel as will be recognized by those of skill in the art. The test indicates that a fuel additive is useful in reducing several different pollutant emissions produced during combustion of a hydrocarbon fuel, if the base scale millimeter, mm reading is lower than the observed additive-treated fuel in the mm reading.

Example 1

A fuel additive of so-called "Iso-Mixtene" a product of DSM chemicals, (formerly, Roche Vitamins, Inc) that is an intermediate in the synthesis of pure trans-beta-carotene and is an admixture of from 89-98% trans β carotene with the remainder being from 1.4 to 11% of isomeric forms of cis β carotene, the admixture being synthesized and packaged in an inert environment prior to use, was added at a 1.0 ml. per gallon with sufficient 6-ethoxy-1,2-dihydro-2,2,4-trimethylquinoline, EDTMQ, to reduce the oxidative effects of dissolved oxygen in the fuel and mixed into a portion of standard Jet fuel and burned in the smoke point testing apparatus described above. This fuel additive exhibited an ASTM smoke point reading of 22.5 mm. when formulated in a standard Jet A or 1 fuel. In comparison, Jet used as a baseline for smoke pint, exhibited typically a Smoke Point of 19.0. The Jet fuel used meets the standards established of Saybolt Laboratories in Carson Calif.

Example 2

Astaxanthin, 3,3'-dihydroxy-4,4' diketo-beta-carotene, from Mera Pharmaceuticals, was mixed to a concentration of about 1.5 grams per gallon of toluene and this solution was then admixed at a concentration of about 0.25 mls. into 50 mls. of standard Jet. When burned in the ASTM Smoke Point apparatus a smoke point of 21.0 was observed, an improvement over Jet A.

Example 3

Example 2 was repeated using astaxanthin but this compound was added to 3 grams per gallon of toluene and this solution was then admixed at 0.25 mls. into 50 mls. of Jet A fuel. This fuel, and additive, exhibited an ASTM smoke point reading of 22.0, an improvement over that of standard Jet A. The result clearly demonstrates a positive concentration dependence of combustion improvement and thus a concomitant reduction in emissions with increasing astaxanthin concentration.

Example 4

Phytic acid, myo-Inositol hexakis (dihydrogen phosphate) as the disodium salt, available from Aldrich Chemical, was mixed at a concentration of 1.5 grams into 450 mls. of toluene. Into: this solution was added 50 mls. of ethoxylated Macadamia nut oil—the ethoxylated portion having, on average, 16 ethylene glycol repeat units. EDTMQ in an amount of 1.0 ml. was admixed into this solution. 0.4 mls. of this additive was added into 50 mls. of Jet A fuel and burned in the ASTM apparatus. The formulation exhibited an ASTM smoke point of between 22.0 and 22.5.

Example 5

Cis-stilbene, 96% pure and available from Aldrich Chemical was admixed at a concentration of 0.25 mls. into 50 mls.

of Jet A fuel and burned in the ASTM smoke point apparatus. A value of 21.0 was obtained. In contrast Jet A exhibits a baseline value of 19.0.

Example 6

Bibenzyl, 99% pure, available from Aldrich Chemical, was added in an amount of 8 grams of bibenzyl admixed into 500 mls. of toluene. 1.0 ml. of EDTMQ was added to complete the test fuel. 8 drops or 0.4 mls. was added into 50 mls. of Jet A and tested for Smoke Point. This fuel exhibited an ASTM smoke point of 22.0.

Example 7

A control sample of toluene and Jet A fuel was prepared using 0.5 mls. toluene in 50 mls. of Jet fuel. A smoke point of 19.0 was observed.

Example 8

A control sample of EDTMQ was prepared by mixing 5.0 mls. of EDTMQ and 500 mls. of toluene were added and 0.25 mls. of this solution was admixed into 50 mls. of Jet A fuel and tested for smoke point. A value of 19.0 was obtained.

Example 9

1,6 diphenyl-1,3,5-hexatriene is added at 3 grams to 3785 mls. of toluene with one ml. of EDTMQ. This additive solution is tested at 0.25 mls. in 50 ml. of Jet fuel. A range of smoke point readings of from 20.0 to 21.0 is observed.

Example 10

A fuel additive based on EXAMPLE 1 was prepared by mixing 2114 ppm of a first solution containing 500 ml of toluene, 12 drops of EDTMQ (Santoquin™), 1.12 grams of Isomixtene and 3170 ppm per gallon of 2-ethyl hexyl nitrate (a cetane improver). The base diesel fuel was a 65/35 blend of an EPA-certified diesel fuel having 19.1% total Aromatics, 48.7 Cetane (by ASTM D-613), Distillation end pint of 662.4 (ASTM D-86), and Sulfur (ASTM D-5453) 62 ppm and a second diesel fuel having 30.2% total Aromatics, 46.2 Cetane (by ASTM D-613), Distillation End Point of 666.1 (ASTM D-86), and Sulfur 416 ppm) (ASTM D-5453). The base and additized fuels were tested for Emissions ($NO_x$, hydrocarbons, particulate matter and carbon monoxide) using a 1992 Detroit Diesel Series 60, 350 HP turbocharged engine; the testing protocol was designed to qualify a fuel for a diesel fuel certificate in the State of Texas ("TCEQ Certification") at West Virginia University, Morgantown, W.Va. The combusted, additized fuel displayed a 4.5% decrease in total $NO_x$, an 8.1% decrease in hydrocarbon content, a 4.1% increase in particulate matter, and a 12.4% decrease in carbon monoxide over the base diesel fuel mixture run under the same conditions.

The claimed invention is:

1. A fuel additive for hydrocarbon fuels comprising:

an additive composition comprising a C12-C50 compound having from 2 to 11 double bonds and at least one cyclic end group, said end group a cyclic 5 to 8 carbon aromatic, cyclo aliphatic, saturated or unsaturated moiety, wherein the additive composition comprises at least an oxygen containing group substituted on at least one of said end groups; and quinoline.

2. The fuel additive of claim 1 wherein the oxygen containing group is elected from the group consisting of hydroxyl groups and keto groups.

3. The fuel additive of claim 1 wherein the additive compound comprises astaxanthin.

4. The fuel additive of claim 1 wherein the additive compound comprises a mixture of astaxanthin and β-carotene.

5. The fuel additive of claim 1 wherein the quinoline is 6-ethoxy-1,2-dihydroxy-2,2,4-trimethyl quinoline.

6. The fuel additive of claim 1 further comprising a solubilizing agent having hydrophilic-lipophilic balance.

7. The fuel additive of claim 6 wherein the solubilizing agent comprises an ethoxylated or propoxylated group containing moiety.

8. The fuel additive of claim 6 wherein said solubilizing agent is macadamia nut oil.

9. A fuel additive comprising astaxanthin and β-carotene wherein said β-carotene comprises a mixture of trans- and cis-isomers, and wherein said additive is suitable for combustion with hydrocarbon fuels.

10. The fuel additive of claim 9 further comprising an antioxidant.

11. The fuel additive of claim 10 further comprising a cetane improver.

12. The fuel additive of claim 11 wherein said cetane improver contains a nitrate group.

13. The fuel additive of claim 11 wherein the cetane improver comprises a quinoline.

14. The fuel additive of claim 11 wherein said cetane improver comprises 6-ethoxy-1,2-dihydro-2,2,4 trimethyl quinoline.

15. The fuel additive of claim 9 further comprising a solubilizing agent.

16. The fuel additive of claim 15 wherein said solubilizing agent comprises an ethyloxated or propoxylated group containing moiety.

17. The fuel additive of claim 15 wherein said solubilizing agent comprises macadamia nut oil.

* * * * *